US008365441B2

(12) United States Patent
Kirby et al.

(10) Patent No.: US 8,365,441 B2
(45) Date of Patent: Feb. 5, 2013

(54) SHOE WITH TRACTION OUTSOLE

(75) Inventors: Gary E. Kirby, St. Charles, MO (US); Daniel M. Doerer, Town & Country, MO (US); Gary A. Woods, Florissant, MO (US)

(73) Assignee: Brown Shoe Company, Inc., St. Louis, MO (US)

( * ) Notice: Subject to any disclaimer, the term of this patent is extended or adjusted under 35 U.S.C. 154(b) by 290 days.

(21) Appl. No.: 12/485,752

(22) Filed: Jun. 16, 2009

(65) Prior Publication Data

US 2009/0307932 A1 Dec. 17, 2009

Related U.S. Application Data

(60) Provisional application No. 61/073,192, filed on Jun. 17, 2008.

(51) Int. Cl.
*A43C 15/00* (2006.01)

(52) U.S. Cl. ..... 36/59 R; 36/59 C

(58) Field of Classification Search ..... 36/8.1, 36/59 R, 59 C, 67 A, 134
See application file for complete search history.

(56) References Cited

U.S. PATENT DOCUMENTS

| | | | | | |
|---|---|---|---|---|---|
| 1,568,064 | A * | 1/1926 | Goldman | 36/59 R |
| 4,322,894 | A * | 4/1982 | Dykes | 36/114 |
| 4,747,220 | A * | 5/1988 | Autry et al. | 36/59 R |
| 5,384,973 | A * | 1/1995 | Lyden | 36/25 R |
| 5,853,844 | A | 12/1998 | Wen | |
| 5,992,053 | A * | 11/1999 | Hansen | 36/7.5 |
| D432,294 | S * | 10/2000 | Wilson | D2/960 |
| D435,334 | S * | 12/2000 | Wilson | D2/960 |
| 6,161,315 | A * | 12/2000 | Dalton | 36/134 |
| 6,276,073 | B1 * | 8/2001 | Curley, Jr. | 36/59 C |
| 6,562,271 | B2 | 5/2003 | Hiraoka et al. | |
| 6,705,027 | B1 * | 3/2004 | Campbell | 36/127 |
| 6,817,117 | B1 * | 11/2004 | Campbell | 36/127 |
| 7,610,695 | B2 * | 11/2009 | Hay | 36/25 R |
| 2002/0004999 | A1 * | 1/2002 | Caine et al. | 36/129 |
| 2002/0078598 | A1 * | 6/2002 | Bell | 36/59 R |
| 2002/0144429 | A1 * | 10/2002 | Hay | 36/25 R |
| 2003/0033734 | A1 * | 2/2003 | McMullin | 36/67 A |
| 2004/0000075 | A1 * | 1/2004 | Auger et al. | 36/128 |
| 2005/0034334 | A1 * | 2/2005 | McMullin | 36/134 |
| 2006/0042124 | A1 * | 3/2006 | Mills et al. | 36/59 C |
| 2007/0107262 | A1 * | 5/2007 | Chang | 36/59 R |
| 2007/0277401 | A1 * | 12/2007 | Young-Chul | 36/30 R |
| 2007/0278714 | A1 | 12/2007 | Johnson | |
| 2008/0229625 | A1 * | 9/2008 | Frasson et al. | 36/59 C |
| 2008/0301973 | A1 * | 12/2008 | Lee Tsai | 36/7.1 R |
| 2009/0090031 | A1 * | 4/2009 | Jung | 36/59 C |
| 2009/0100718 | A1 * | 4/2009 | Gerber | 36/128 |
| 2010/0229426 | A1 * | 9/2010 | Brown | 36/129 |

* cited by examiner

*Primary Examiner* — Darnell Jayne
*Assistant Examiner* — Devin Barnett
(74) *Attorney, Agent, or Firm* — Husch Blackwell LLP

(57) ABSTRACT

A shoe with an outsole having at least one traction zone, the traction zone including a base surface in a first plane, a plurality of ground engaging members in a second plane and a plurality of intersecting grooves defined by a pair of opposing walls and a groove surface located in a third plane. The base surface includes a plurality of spaced apart base surface elements. The plurality of intersecting grooves are positioned adjacent the plurality of base surface segments and the ground engaging members. The first, second and third planes are positioned elevationally in spaced apart arrangement from one another. The ground engaging members project out beyond the first plane while the intersecting grooves are recessed from the first plane toward a shoe upper. Each of the ground engaging members includes side walls and an angled first surface for contacting the ground.

10 Claims, 2 Drawing Sheets

SHOE WITH TRACTION OUTSOLE

CROSS-REFERENCE TO RELATED APPLICATION

This application claims the benefit of and priority to U.S. Provisional Patent Application Ser. No. 61/073,192, filed Jun. 17, 2008, entitled SHOE WITH TRACTION OUTSOLE, which application is hereby incorporated by reference to the extent permitted by law.

BACKGROUND OF THE INVENTION

This invention relates generally to an outsole adapted for use on a shoe such as athletic shoes or sneakers. More particularly, the invention relates to an integrally-formed traction outsole having transverse grooves and cleats or lugs adapted to expel or channel water away from the outsole through sloped surfaces and thereby to maintain rubber contact with the ground. Each cleat has sloped top surfaces to facilitate the deflection or flow of water.

Shoes with outsoles to provide improved traction are known in the art. Although prior art traction outsole designs have improved wet traction, it is a continuing goal in the art to further improve wet traction. Two general approaches have been taken with these shoes. One approach is to provide a compound from which the outsole is made with a higher coefficient of friction. Such soles may be found on some climbing and outdoor shoes. A second approach to improved traction is to provide a sole with cleats or lugs. It has been the practice to equip athletic shoes with a variety of protruding ridges or cleats on the bottom of the sole so as to enhance traction. One approach, that of using a series of transverse grooves or ridges, has seen wide use in the field of rubber outsoles for shoes generally for use in applications where such a grooved or bumpy surface serves to enhance traction against smooth wet surfaces such as asphalt walks or tile floors.

While higher traction may be provided, in normal use, the currently available outsoles do not necessarily provide improved traction on wet surfaces. Wet surfaces provide a special case for friction. The wetness or water provides a lubricant or lubricant film between the outsole and the ground reducing the amount of friction available for traction.

Thus, there is a need for an improved shoe with outsole for improved water drainage and increased wet traction while providing for the comfort of the wearer. An improved traction zone configuration with an improved cleat configuration that provides the wearer with added traction during pushoff and braking is desirable.

SUMMARY OF THE INVENTION

The present invention is directed to a shoe outsole having a traction zone structure. The shoe includes an upper, a midsole and an outsole. The outsole is secured to the upper or midsole such as by cementing and/or stitching and has a base surface portion with a heel region and a forefoot region.

In one aspect of the present invention, a shoe outsole having a traction zone is disclosed. The present invention involves the provision of sloped or angled traction elements. The outsole provides for engagement with the ground while the upper is used to secure the shoe to the wearer's foot. The outsole includes a plurality of zones. The first zone provides a bed for supporting the foot. While conventional traction zones, which have no angled surfaces, are somewhat effective in deflecting water, they suffer from several disadvantages.

One embodiment of the present invention has the benefit of inclined or convex outer surfaces associated with the ground engaging elements. As the ground water impacts the inclined surfaces it is deflected around the angled surfaces. The water then moves through the multi-layered fluid flow channels associated with the traction zone for exiting out of the outsole surface.

The present invention comprises a base surface having a plurality of spaced apart base surface segments in a first plane, a plurality of ground engaging members in a second plane and a plurality of intersecting grooves positioned adjacent the plurality of base surface segments and the ground engaging members. Each of the intersecting grooves is defined by a pair of opposing walls and a groove surface in a third plane. The first, second and third planes are positioned elevationally in spaced apart arrangement. The ground engaging members project out beyond the first plane. The intersecting grooves are recessed from the first plane toward a shoe upper. Each of the ground engaging members includes side walls and an angled first surface for contacting the ground.

The base surface and side walls of the intersecting grooves form fluid flow channels to an outer perimeter of the outsole. The intersecting grooves are positioned adjacent the base surface segments and the ground engaging members.

The ground engaging members may be lugs or cleats. The outer surface of each ground engaging member at its free or terminal end forms an angled or curved surface such as a beveled surface or a convex surface. Each ground engaging member includes a plurality of posts formed at its four outer corners for contacting the ground, each post including a curved surface at its free end. The ground engaging members cover in the range of between about 5% and about 25% of the total projected area of the traction zone structure.

In another embodiment, positioned above the bed zone is a first channel zone providing for a plurality of laterally extending channels for a flow of water to exit from under the outsole. The second zone is positioned above the first channel zone and provides a second channel zone having larger laterally extending channels to permit the flow of water out from under the outsole and also provides a secondary ground engaging surface. The second channel zone also provides a plurality of discrete surface segments which form the secondary ground engaging surfaces with these discreet surface segments being separated by the channels in the first channel zone. The third zone is a primary ground engaging zone providing a plurality of discreet surfaces for initial engagement with the ground. The discreet surfaces are separated by the channels in the second channel zone. The channels in the first and second channel zones intersect with other channels therein and with one another to assist in transfer of water from under the sole to the outer perimeter of the sole for discharge therefrom.

Specific advantages and features of the present system will be apparent from the accompanying drawings and the description of several illustrative embodiments of the present invention.

It should be understood that the drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized throughout the various figures designate like or similar parts or structure.

DETAILED DESCRIPTION

Figure 1:
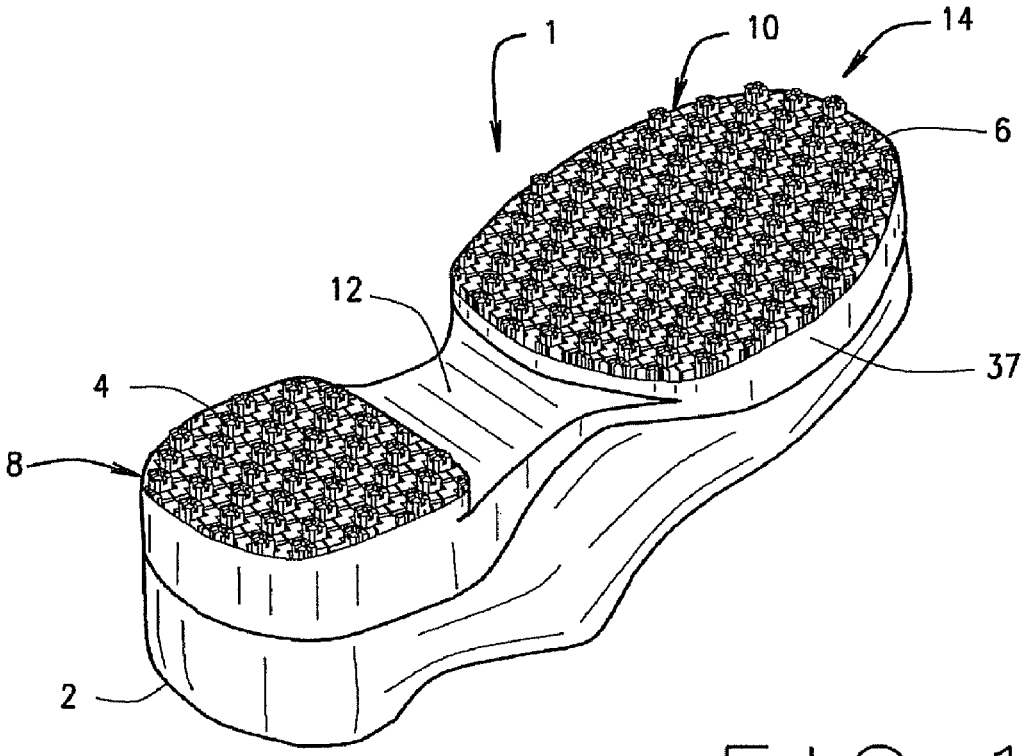
FIG. 1 is a perspective view of a shoe showing an upper and outsole constructed in accordance with the teachings of the present invention.

The article of footwear is generally referred to herein as a shoe 1. As illustrated in FIG. 1, shoe 1 includes an upper 2 being attached to a sole including an outsole 4 having a plurality of downwardly extending ground engaging members 6 such as cleats or lugs. Shoe 1 advantageously enhances traction control and stability of a foot of a wearer. The upper 2 may be secured to the outsole 4 in any suitable manner as for example by stitching and/or cementing as is known in the art. In one embodiment, the outsole 4, as illustrated, has two primary ground engagement regions 8, 10 with the heel region 8 being the heel area of the outsole 4 and the forefoot region 10 being the forefoot area located under the toes and ball of the foot. A recessed arch area 12 can be provided if desired. While an outsole 4 is shown illustrating three distinct bottom regions, it is to be understood that the traction area 14 of the outsole 4 may include substantially the entirety of the bottom of the outsole 4. Outsole 4 functions to provide a ground engaging component of shoe 1 designed for traction and is typically made of a substantially abrasion resistance material.

Figure 2:
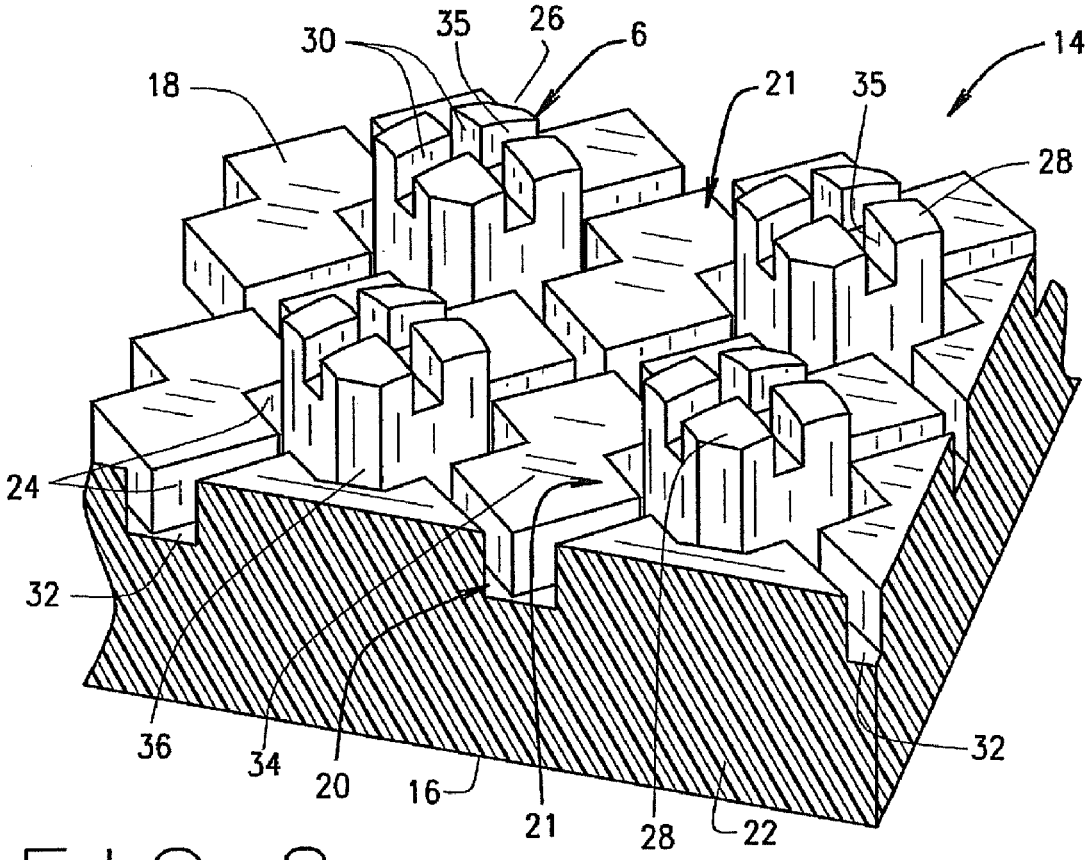
FIG. 2 is an enlarged fragmentary view of a portion of the present outsole showing details of the traction zone structure with the outsole being shown bottom side up.

FIG. 2 illustrates a fragmentary enlarged portion of the outsole 4 hereinafter referred to as a traction zone 14. In the shoe illustrated in FIG. 1, the heel and forefoot regions 8, 10 of the outsole 4 each include a traction zone 14. FIG. 2 illustrates the traction zone 14 inverted wherein the upper 2 would be on the bottom of the traction zone 14 as illustrated in FIG. 2. Terms designating relative positions up, down, top, bottom, for example, are for the outsole and shoe from the orientation shown in FIG. 2.

The upper 2 is secured to an upper surface (not shown) of the outsole 4 such as by stitching, cementing, or mechanically attaching the outsole 4 to the upper 2. The outsole 4 includes a base surface 18 and a plurality of engaging members 6 extending upward from the base surface 18. The outsole 4 further includes a plurality of grooves 20 formed below the base surface 18, which separates the base surface 18 into a plurality of islands 21 (base surface segments). Such islands 21 may have the somewhat figure eight shape with pointed corners as shown in FIG. 2, and referred to herein as a "somewhat figure eight shape." The outsole 4 includes a bed zone 22 for substantially continuous support of a foot in the shoe 1 as characterized by a relatively smooth surface 16 underlying the foot. The surface 16 is preferably at least substantially continuous for foot comfort. Positioned above the bed zone 22 are the grooves 20 that form the lower channels 24

Figure 3A:
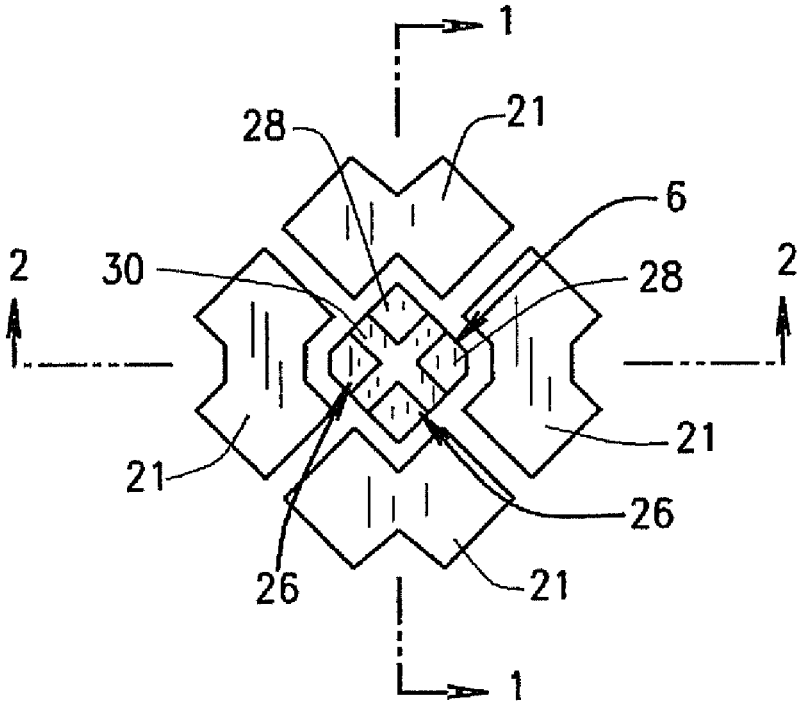
FIG. 3A is an enlarged top plan view of a portion of the outsole showing details of the traction surface portion.
Figure 3B:
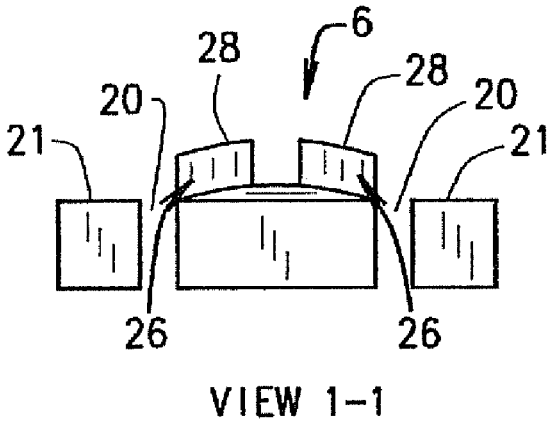
FIG. 3B is a cross-sectional view of the present traction zone structure taken along line 1-1 of FIG. 2.
Figure 3C:
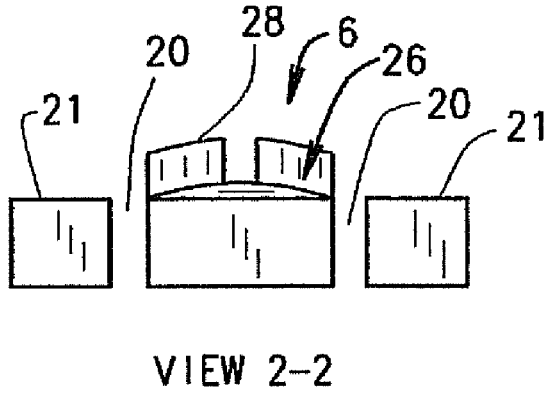
FIG. 3C is a cross-sectional view of the present traction zone structure taken along line 2-2 of FIG. 2.

The outsole 4 includes upstanding ground engaging members 6. The ground engaging members on the heel region 8 and the forefoot region 10 each are similarly shaped to include a protrusion, such as cleats or lugs, which enhances stability of the wearer's feet in relation to the ground surface by aiding in preventing shear force slippage. The ground engaging members 6 are mounted to the outsole 4. "Cleat" refers to a stud on the bottom of the shoe. Unlike "spikes" for sports such as track and field and baseball, the shoes generally have large studs on the bottom to assist in gripping the surface, preventing sliding and assisting in rapid changes of direction. The stud itself is often called a cleat. The cleat may include a metal or plastic piece that attaches to the bottom of a shoe. "Lugs" refer to discontinuous radial rows of tread rubber in direct contact with the ground surface. The ground engaging members 6 are preferably arranged relatively close to each other as illustrated in FIGS. 1 and 2. The ground engaging members 6 are laterally and longitudinally spaced apart from each other in an X-Y matrix or array, e.g. rows and columns or rows and staggered columns. In one embodiment, the ground engaging members 6 can have any suitable transverse cross-sectional shape and as shown, include a generally rectangular shape having beveled corners or posts 26. As illustrated in FIGS. 3A, 3B and 3C each of the ground engaging members 6 preferably includes an upward facing downwardly inclined ground engaging surface, e.g., a curved or angled leading surface 28. Preferably the ground engaging members 6 each have a domed top surface with multiple beveled posts 26. Generally, various suitable geometries may be employed to achieve similar effect, including substantially conical or parabolic forms. Water paths or channels 30 are formed on the top surface 28 of each ground engaging member 6. Further, as illustrated in FIGS. 2 and 3A, upper channels 30 are defined by and between the beveled posts 26. The water paths 30 are recessed or indented into the top surfaces 28 of each ground engaging member 6 as best illustrated in FIG. 2 and along with the curved or angled surfaces 28 of the ground engaging members 6 will permit water to splash or flow therethrough.

The ground engaging members 6 are integrally formed by molding, such as compression molding. The water hits the top surfaces 28 of the ground engaging members 6 and splashes up diagonally (relative to the horizontal) onto the base surface 18 or the bottom surfaces 32 of the grooves 20. The ground engaging members 6 are arranged in an array and are positioned relatively close to each other in rows and columns or offset rows and columns and cover a substantial portion of the outsole 4. The projected surface area of the ground engaging members 6 is in the range of between about 5% and about 25% of the total projected area of the traction zone 14.

The ground engaging members 6 are circumscribed by the lower channels 24 and also by the middle channels 34. The ground engaging members 6 have the top surfaces 28 which provide for the primary contact zone with the ground during use of the shoe 1. The ground engaging members 6 are resiliently deformable and have a hardness sufficient for their cross-sectional size and shape, and are spaced apart to permit their deformation so as to provide a secondary contact zone by the base surfaces 18 of the islands 21. In the illustrated structure, the inner side walls 35 of the beveled posts 26 form the upper channels 30 to provide a flow path for water to flow from under the ground engaging members 6 into the middle 34 or lower 34 channels. As shown, the upper channels 30 are in a plus or cross (+) shape and include at their open top ends a surface area. As compared to the traction zone, the surface area of the ground engaging members 6 is in the range of between about 5% and about 25% the total projected base surface area of the ground engaging members 6. The width of the upper channels 30 is on the order of between about 0.5 mm and about 1 mm.

A plurality of grooves 20 are provided to form one or more lower water channels 24 that open upwardly as illustrated in FIG. 2. To create an even larger space for water to move through the surface of the outsole 4, the base surface 18 of the outsole 4 may also include a plurality of grooves 20 or recessed areas. "Groove" means an elongated void area in a tread that may extend circumferentially or laterally about the tread in a straight, curved, or zig-zag manner. Grooves ordinarily remain open in the shoe footprint. The lower channels 24 have surfaces 32 and extend at least generally laterally between opposite side edges of the outsole 4 and open onto the outer perimeter 37 of the outsole 4. The lower channels 24 provide generally laterally extending flow paths to permit the outflow of water under the outsole 4 during use of the shoe 1. In one embodiment, the lower channels 24 are interconnected. The lower channels 24, as illustrated in FIGS. 2 and 3A, surround ground engaging members 6 and islands 21 of the base surface 18 as illustrated in FIGS. 2 and 3A. In the preferred embodiment, the grooves 20 form a plurality of lower channels 24.

As compared to the traction zone 14, the surface area of the surfaces 32 of the lower channels 24 where they open into the middle channel, is in the range of between about 5% and about 25% of the total projected surface area of the traction zone 14. Preferably, the lower channels 24 have a width in a range of between about 0.5 mm and about 1 mm where they open into the middle channels 34.

The middle channel 34 is a second channel zone providing larger channels that open onto the perimeter 37 for the outflow of water. In one embodiment, a plurality of middle channels 34 are formed when the ground engaging members 6 are engaged with the ground such that the middle channels 34 are enclosed by the ground surface, base surface 18 and outer side walls 36 of the ground engaging members 6. The middle channels 34 extend at least laterally to the side edges of the perimeter 37. The middle channels 34 are preferably interconnected and have respective channels 34 opening thereinto. The middle channels 34 allow water to exit from the outsole 4. The middle channels 34 are partially defined by the base surfaces 18 of the islands 21. In a preferred embodiment, the projected area of the base surfaces (i.e., the surface area as calculated by the xy dimensions of the islands 21) is in the range of between about 50% and about 75% of the total projected surface area of the traction zone 14. The base surfaces 18 provide a secondary contact zone for engagement of the outsole 4 with the ground. The ground engaging members 6 generally elevate the base surface 18 of the outsole above the ground. When the outsole 4 is in contact with wet ground, the water splashes along the sloped top surfaces 28 of the ground engaging members 6 and flows through the upper, middle and lower channels 24, 30 and 34 toward the outside of the outsole 4. Although such channels are designed to facilitate water removal in conjunction with the shoe 1, the sloped surfaces can aid in water removal from the ground engaging surface of the outsole 4.

One of the problems with materials having higher coefficient of friction is both the expense of producing the outsole and that such outsoles are typically black in color. Lugged soles tend to be heavy and stiff and when used, have a rough feeling to the wearer of the shoe when walking or running. Additionally, lugged soles have a high amount of area as a percentage of the total outsole area that does not contact the ground. Lugged soles are also typically meant for rough terrain such as rocks and dirt where interference between edges of the lugs and the walking surface provide for higher traction. The less area in contact with the ground, the faster the outsole will wear. Higher coefficient of friction materials also tend to wear faster because they tend to be softer materials. The traction zone should have good frictional performance and should be resistant to abrasion and stress. Thus, the outsole 4 is made of an elastomer material that can be either thermoset or thermoplastic material. Such materials are well known in the art of shoe soles and can include, but are not limited to, thermoplastic rubber and vulcanized rubber.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A shoe outsole having at least a portion of an exposed traction zone structure, the exposed traction zone structure comprising:

a base surface having a plurality of base surface segments positioned in spaced apart arrangement from one another;

a plurality of ground engaging members, each said ground engaging member projecting out beyond said base surface, at least one of said plurality of ground engaging members including an upper channel formed in a top surface thereof, where each ground engaging member is generally cross-shaped and defines four posts for contacting the ground, each said post including an angled surface at its free end for contacting a ground surface, and each said ground engaging member including side walls, said base segments and said side walls forming one or more middle fluid flow channels therebetween to an outer perimeter of the outsole, said ground engaging members being integrally formed with the outsole; and a plurality of intersecting grooves positioned adjacent said plurality of base surface segments and said ground engaging members, each of said intersecting grooves being defined by a pair of opposing walls and a groove surface, said groove surface being recessed from the base surface toward a shoe upper, said groove surface and opposing walls forming one or more lower fluid flow channels to the outer perimeter of the outsole;

wherein said ground engaging members are spaced apart from said base segments by one of said channels such that said ground engaging members are not directly connected to said base segments.

2. The shoe outsole of claim 1 wherein said ground engaging members are lugs or cleats.

3. The shoe outsole of claim 1 wherein said ground engaging members cover in the range of between about 5% and about 25% of the total projected area of the traction zone structure.

4. The shoe outsole of claim 1 wherein each said angled first surface is a beveled surface.

5. The shoe outsole of claim 1 wherein each said angled first surface is a convex surface.

6. The shoe outsole of claim 1 wherein the exposed traction zone structure is foamed from vulcanized rubber.

7. A shoe outsole having at least a portion of an exposed traction zone structure, the exposed traction zone structure comprising:

a base surface being exposed to a ground surface, said base surface including a plurality of base surface segments spaced apart from one another;

a plurality of ground engaging members, each said ground engaging member being a protrusion extending from the outsole to a tip surface, said base surface segments and said ground engaging members forming one or more middle fluid flow channels therebetween, said protrusion having a convexly curved edge opposite said base surface, and said tip surface having an indented portion forming upper fluid flow channels therein, said ground engaging members being integrally formed with the outsole, and wherein said indented portion is generally cross-shaped and defines four posts for contacting the ground, each said post including a curved surface at its free end;

a plurality of intersecting grooves positioned adjacent said plurality of base surface segments and said ground engaging members, each of said intersecting grooves being defined by a pair of opposing walls and a groove surface, said groove surface being recessed from the base surface toward a shoe upper, said groove surface and said opposing walls forming one or more lower fluid flow channels to the outer perimeter of the outsole; and wherein said ground engaging members are spaced apart from said base segments by one of said channels such that said ground engaging members are not directly connected to said base segments.

8. The shoe outsole of claim 7 wherein said ground engaging members are lugs or cleats.

9. The shoe outsole of claim 7 wherein said ground engaging members cover in the range of between about 5% and about 25% of the total projected area of the traction zone structure.

10. The shoe outsole of claim 7 wherein the exposed traction zone structure is formed from vulcanized rubber.

* * * * *

UNITED STATES PATENT AND TRADEMARK OFFICE

CERTIFICATE OF CORRECTION

PATENT NO. : 8,365,441 B2
APPLICATION NO. : 12/485752
DATED : February 5, 2013
INVENTOR(S) : Gary E. Kirby It is certified that error appears in the above-identified patent and that said Letters Patent is hereby corrected as shown below:

At Col. 6, line 67, in Claim 6, delete "foamed" and replace with -- formed --

Signed and Sealed this
Second Day of April, 2013

Teresa Stanek Rea
*Acting Director of the United States Patent and Trademark Office*